United States Patent [19]

Beekel

[11] Patent Number: 5,000,025

[45] Date of Patent: Mar. 19, 1991

[54] EXTRUSION MACHINERY

[75] Inventor: Eugene A. Beekel, Adrian, Mich.

[73] Assignee: Brazeway, Inc., Adrian, Mich.

[21] Appl. No.: 516,749

[22] Filed: Apr. 30, 1990

[51] Int. Cl.[5] ..... B21C 23/24; B21C 25/06

[52] U.S. Cl. ..... 72/259; 72/262; 72/268; 72/467

[58] Field of Search ..... 72/262, 259, 268, 269, 72/264, 467

[56] References Cited

U.S. PATENT DOCUMENTS

| | | | |
|---|---|---|---|
| Re. 32,399 | 4/1987 | Nagai et al. | 72/262 |
| 4,208,898 | 6/1980 | Ames et al. | 72/262 |
| 4,564,347 | 1/1986 | Vaughan | 72/268 |
| 4,831,859 | 5/1989 | Cleve et al. | 72/269 |

FOREIGN PATENT DOCUMENTS

| | | | |
|---|---|---|---|
| 58-86929 | 5/1983 | Japan | 72/262 |

*Primary Examiner*—Robert L. Spruill
*Attorney, Agent, or Firm*—Krass & Young

[57] ABSTRACT

A two wheel conform type aluminum extrusion machine and a die assembly and subassembly for extruding tubing and/or cladding a core material. The die subassembly permits lateral adjustment of a die ring relative to a mandrel to assure uniform wall thickness in the extruded tubing. A method of utilizing the die subassembly comprises assembly thereof and prefilling the subassembly with molten aluminum.

14 Claims, 4 Drawing Sheets

FIG - 5
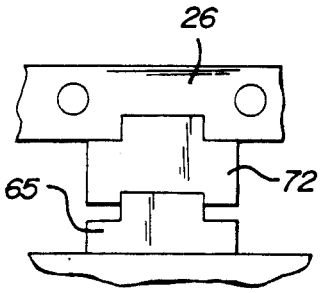
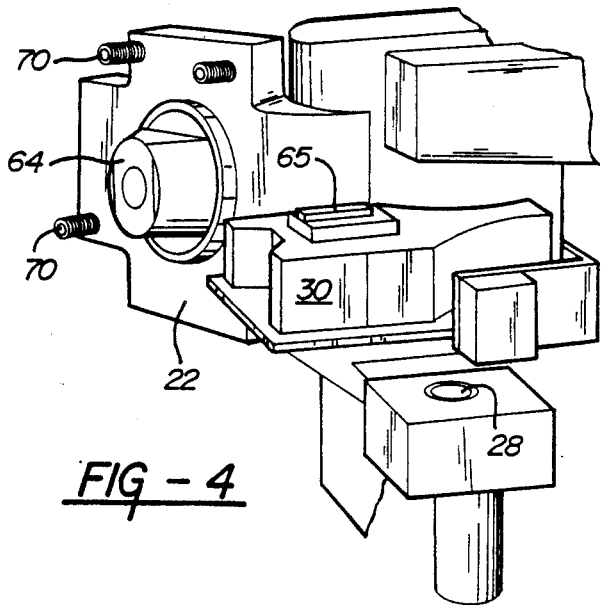
FIG - 4
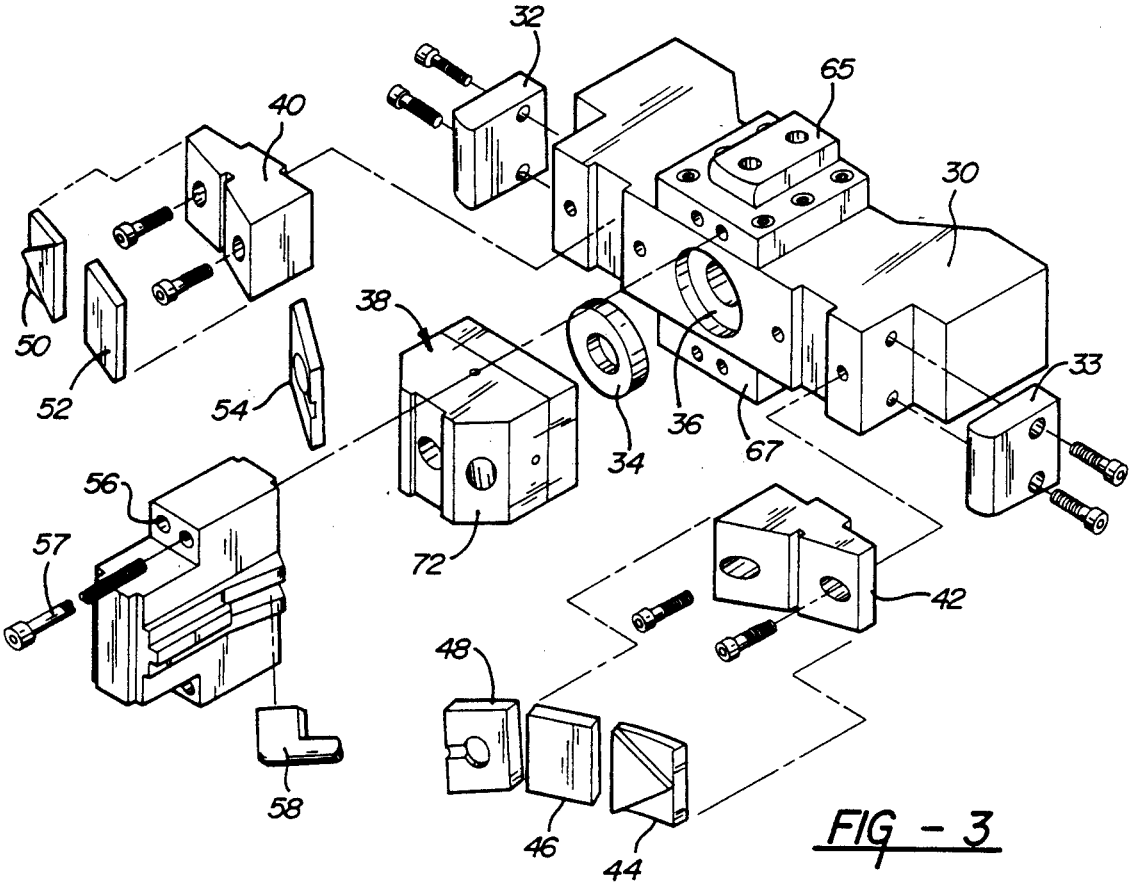
FIG - 3

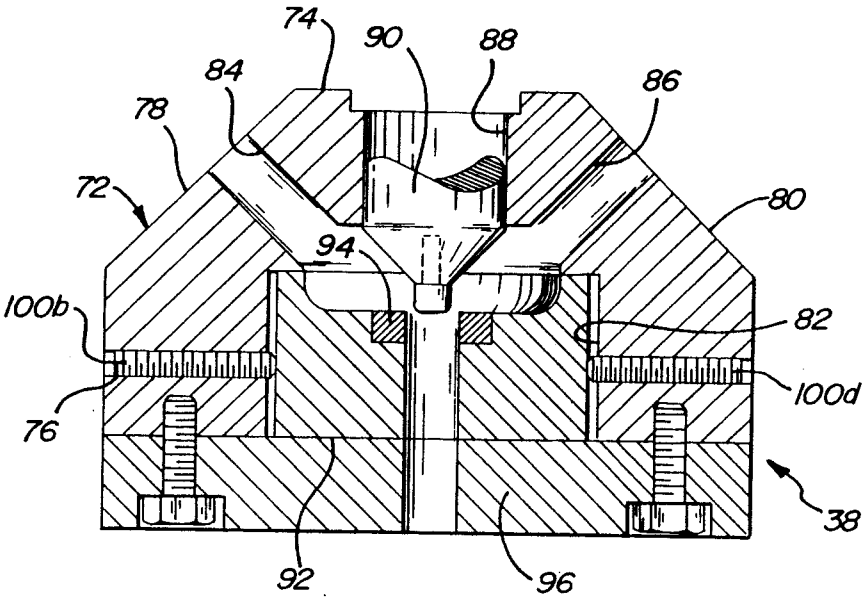
FIG - 7
FIG - 6
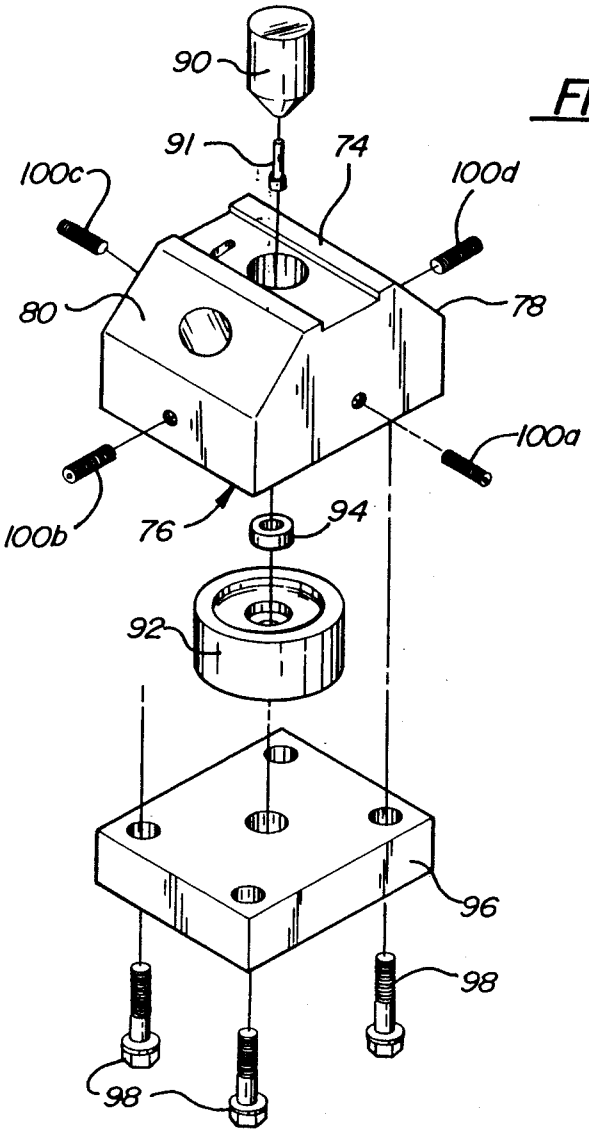

EXTRUSION MACHINERY

INTRODUCTION

This patent relates to metal extrusion and more particularly to the construction, setup and use of a tooling assembly for metal extrusion machines of the type which utilize friction wheels to feed metal stock, typically in coiled rod form, into an extrusion die.

BACKGROUND OF THE TECHNOLOGY

British patent specification 1,370,894 "Improvements in or Relating to Extrusion" published Oct. 16, 1974 and U.S. Pat. Nos. 3,765,216 and 4,564,347, both assigned to Babcock Wire Equipment Ltd. of Ashford, England, disclose an extrusion machine having a rotatable wheel formed with two identical circumferential grooves and tooling disposed immediately adjacent the periphery of the wheel and provided with channels extending from positions adjacent the grooves to a mixing chamber having a portal mandrel; i.e., a mandrel centered in a die orifice. When, for example, coiled rod metal stock is fed into the wheel grooves and thence into the mixing chamber, a tubular extrusion discharges axially of the die orifice. The metal stock is fluidized by friction-induced heat and pressure in the wheel grooves and stock from the two grooves blends together and emerges as a single integral extrusion.

The machinery and process described immediately above may be used to produce both solid and tubular extrusion and to apply the feed stock as a cladding or sheath to a cored material which is fed axially through the center of the mandrel.

Two-wheel machines are also known, using the fundamental principle of the single wheel machine but feeding stock into the die from essentially laterally opposite input ports; i.e., the two wheels operate in mirror-image fashion relative to a central die assembly. See for example, U.S. Pat. No. 4,217,852, Re. 32,385. Specifically, the wheels rotate in opposite directions around spaced parallel axes and the tooling is disposed between the two wheels and adjacent peripheral portions thereof. While greater mechanical input power is required to drive two wheels than to drive one, the two-wheel machine is capable of substantially greater production rates than the single wheel machine. Moreover, the two wheel machine is believed to fill the extrusion cavity more uniformly and produce a more homogeneous product.

For many applications, extruded tubing must exhibit a high quality surface finish, uniform density and uniform wall thickness; e.g., wall thickness tolerances may be on the order of 0.0015". To achieve these results it is essential to achieve stability in the spatial relationships between the various components of the aforementioned machine, the die and the die holder. Variations in the gap between the wheels and the feed passage components produce swings in power consumption and extrusion stock temperature and can seriously degrade surface finish and density. Under some circumstances, actual metal-to-metal contact between the die components and the wheels may occur.

Similarly, shifts between the die and the mandrel which defines the inner diameter of the tube produce variations in wall thickness and tubing strength. Where thin wall, small diameter tubing is to be used, for example, in refrigeration systems which require the tubing to be bent for forming variations in wall thickness can produce unacceptable results.

Stability in the spatial relationships between the components of the die assembly and the wheels of the machine is particularly difficult to achieve not only in view of the pressures involved, but also in view of the substantial temperature gradients an-.d substantial temperatures excursions which are produced by friction and pressure. These temperature excursions produce thermal growth of various structural components, the directions and magnitudes of which must be predicted and/or controlled or compensated with high accuracy.

SUMMARY OF THE DISCLOSURE

A die assembly, a die subassembly and a die assembly mounting structure for two-wheel extrusion machines are disclosed. The die assembly, although preferably constructed in several intermounted components, presents an integrated and solid stack of rigid components having a rear terminal surface which bears against a fixed stop in the machine and a forward terminal surface which bears directly or indirectly against a door, the distance between the rear and forward terminal surfaces being fixed and independent of die location. A die is mounted on the longitudinal axis of the die assembly and in fixed spatial relationship to between the terminal surfaces to receive fluidized stock from essentially opposite input channels having outboard ports which, when the die assembly is installed, are aligned with the wheel grooves. This device contemplates a single groove in each of the friction wheels.

In addition, the die assembly described herein is adapted to cooperate with guide means fixed to the machine frame for slidably locating the die assembly symmetrically between the wheel axes with the longitudinal axis of the die assembly perpendicular to the wheel axes. The guide means locates the rear terminal surface of the extrusion die assembly against the aforementioned fixed stop such that the proper spatial relationship is achieved between the components of the die assembly and the peripheral surfaces of the wheel. In a typical installation, means such as an hydraulic cylinder are provided for applying longitudinal compressive force to and against the forward terminal surface of the die assembly to hold the die assembly against the stop during operation.

The die subassembly comprises a die block having a rear surface, a front surface, opposite angled lateral exterior surfaces, a central cavity and stock feed channels extending inwardly from ports in the angled exterior surfaces to the cavity. An axial through-bore between the front and rear surfaces provides a mounting location for an extrusion mandrel which may be either hollow or solid to clad or extrude tubular material, respectively. The extrusion die subassembly further comprises an insert having an axial bore mounted in the cavity adjacent the front surface and axially aligned with the mandrel to define the inner and outer diameters of an extrusion. Finally, the subassembly comprises means for laterally and axially securing the insert in the die block. In the preferred form, the securing means is constructed to permit lateral adjustment in the position of the insert relative to the die block, thereby to produce uniform wall thickness in the extruded tubing and/or a uniform cladding thickness if feed stock is applied as a cladding over a core.

BRIEF DESCRIPTION OF THE DRAWINGS

FIG. 3 is an exploded view of the extrusion shoe assembly of FIG. 1;

FIG. 4 is a partial assembly, in perspective, showing the manner of installing the die assembly in the machine;

FIG. 5 is an end view of the guidance components utilized for installing the die assembly in the machine of FIG. 4;

FIG. 6 is an exploded view of a die subassembly in perspective;

FIG. 7 is a sectional view through the die subassembly showing the relationship between the insert and the mandrel;

DETAILED DESCRIPTION OF AN ILLUSTRATIVE EMBODIMENT

A. Construction of the Die Assembly

Figure 1:
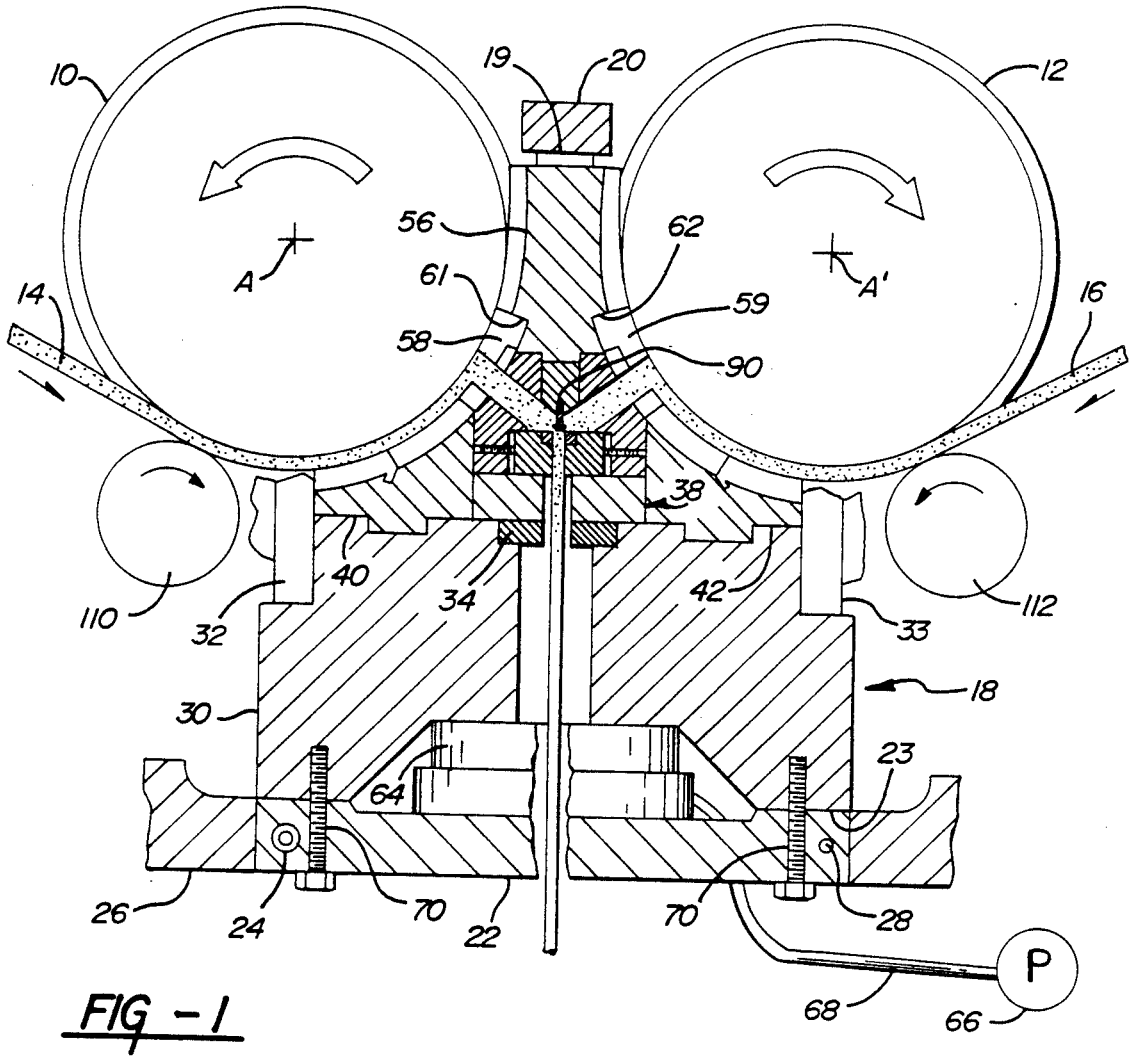
FIG. 1 is a plan view of a representative extrusion shoe assembly in position relative to the wheels of a two-wheel extrusion machine.
Figure 2:
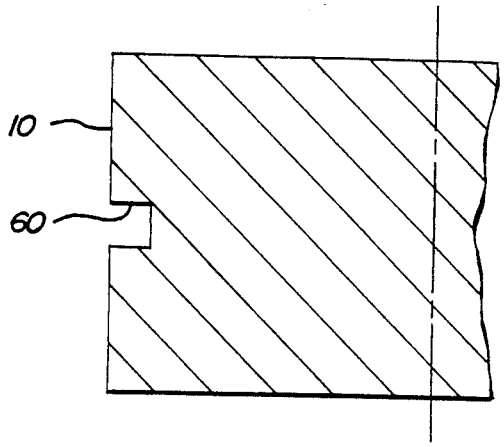
FIG. 2 is a partial sectional view through an extrusion wheel showing the configuration of the peripheral groove.

FIG. 1 shows in plan view horizontal stock feed wheels 10 and 12 having vertical parallel spaced axes of rotation A and A', respectively, for feeding aluminum rod stock 14 and 16 into an extrusion die assembly 18 having a horizontal axial output path. The arrangement shown in FIG. 1 is essentially symmetrical about the central horizontal longitudinal axis.

Die assembly 18 slides as a unit into the extrusion machine mediate the wheels 10 and 12 until the rear terminal surface 19 thereof abuts a stop 20 which is rigidly affixed to or integral with the extrusion machine frame 26. A heavy steel door 22 pivotally connected at 24 to the machine frame 26 abuts the forward terminal surfaces 23 of the die assembly 18 to hold the die assembly against the fixed stop 20. A lock pin 28 holds the door 22 closed to the machine frame 26 during operation as hereinafter described.

Looking now to FIG. 3 in combination with FIG. 1, the die assembly 18, although comprising numerous components, is insertable into and removable from the extrusion machine as a unit. Moreover, the construction of the assembly 18, as hereinafter explained, is such as to provide a solid stack of components from the rear terminal surface 19 to the forward terminal surfaces 23 through which longitudinal operating forces are transmitted. Moreover, all dimensions are referenced to the rear terminal surface 19 which abuts the fixed stop 20 of the machine frame, thereby to ensure proper clearances relative to the peripheral surfaces of the grooved wheels 10 and 12 during operation as hereinafter explained.

The die assembly 18 comprises a machined steel die shoe 30 having right and left lateral support blocks 32 and 33 secured to outer peripheral surfaces of the shoe by machine bolts as shown. An annular block 34 fits into a cylindrical recess 36 in the shoe 30 to provide underlying support for the backer plate of the die subassembly 38 hereinafter described in greater detail with reference to FIGS. 6–9. Several blocks 34 with different hole sizes for different extrusion diameters maybe provided; i.e., if a larger extrusion diameter is chosen, a block 34 with a correspondingly larger internal hole size is also chosen. Wing blocks 40 and 42 having keyed bearing surfaces and arcuate exterior surfaces are keyed and bolted in symmetrical positions to the rear surfaces of the shoe 30 as shown in FIG. 3. The arcuate surfaces merge contiguously with similarly beveled or angled lateral surfaces on the die subassembly 38 as hereinafter described to provide bearing surfaces for feed stock channel friction plates 44, 46, 48, 50, 52 and 54 of H13 steel. Plates 48 and 54 are ported to correspond with ports in the die block 72 hereinafter described. Plates 48 and 54 are also grooved to receive abutments 58 and 59 as shown in FIG. 1. Plates 44,46 and 48 are compressively trapped between block 32 and abutment 58. This compression, aided by extrusion forces, holds the plates to the curved surface of block 40. Plates 50,52 and 54 are similarly secured. Unnumbered machine bolts are utilized to secure the wing blocks 40 and 42 in place.

Plates 44 and 52 are machined to provide a surface pattern in the shape of a raised arrow pointing opposite the inbound flow of extrusion material to effectively scrape off of the wheel surface any old metal carried in by the wheel from a previous revolution.

An abutment holder 56 is keyed into and abuts against the rear surface of the die subassembly 38 and long machine screws 57 are used to mechanically tie the abutment holder 56 to the shoe 30, both top and bottom; i.e., above and below the die subassembly 38. The machine screws 57 do not pass through the die subassembly. Abutments 58 and 59 are disposed in and carried by laterally opposite slots in the abutment holder 56 in mirror image fashion and extend into the grooves 60 of the wheels 10 and 12 to provide a turning point for fluidized feed stock as illustrated in FIG. 1. The abutments 58 and 59 are mechanically abutted against machine shoulders 61 and 62 in the abutment holder 56.

Once the die assembly 18 is in position between the wheels 10 and 12 as shown in FIG. 1, the door 22 is swung closed and the lock pin 28 inserted by means of an air cylinder or the like. An hydraulic door cylinder 64 carried by the door 22 is activated by pump 66 and hydraulic lines 68 to apply a compressive force to and longitudinally of the die assembly 18 along the extrusion output axis. It will be appreciated from the drawing of FIG. 1 that this compressive force urges the die assembly 18 firmly against the rear stop 20. Through bolts 70 may be used to tie the door 22 and the machine frame 26 to the die assembly 18 if desired. A symmetrical square pattern of bolts is used as appears in FIG. 4.

FIG. 5 illustrates the use of an upper guide block 72 which is suitably secured to the machine frame 76 on the longitudinal axis of symmetry. Guide block 72 is longitudinally grooved to receive the outwardly extending flange of the slide block 65 which is mounted on top of the shoe 30. Lower block 67 also longitudinally guides the assembly 18 in the machine.

Referring now to FIGS. 6–9, details of the die subassembly 38 are described. This subassembly comprises a die block 72 having a rear surface 74 which is relieved vertically to receive the abutment holder 56 as previously described. In addition, die block 72 has a flat forward surface 76 and opposite angled lateral exterior surfaces 78 and 80. Die block 72 has formed therein an interior cavity 82, stock feed channels 84 and 86 extending inwardly from ports in the angled exterior surfaces 78,80 to the cavity 82 and an axial through-bore 88 extending from the relieved rear surface 74 through to the cavity and via the cavity 82 to the forward surface 76.

A mandrel holder 90 and removable mandrel 91 is shrink-fit into the bore 8 adjacent the rearward surface. Mandrel 91 defines the internal diameter of a tubular extrusion to be manufactured utilizing the die subassembly herein described. A ring holder 92 fits within the cylindrical portion of the cavity 82 and carries essentially integrally therewith a carbide die ring 94 which defines the outer diameter of the tubular extrusion. As shown best in FIG. 7, the ring holder 92 extends 0.004" above the surface 76. Backer plate 96 is held by machine screws 98, the heads of which are recessed into the backer plate 96 to the die block 72, thereby to clamp the ring holder 92 in the die block 72.

Figure 8:
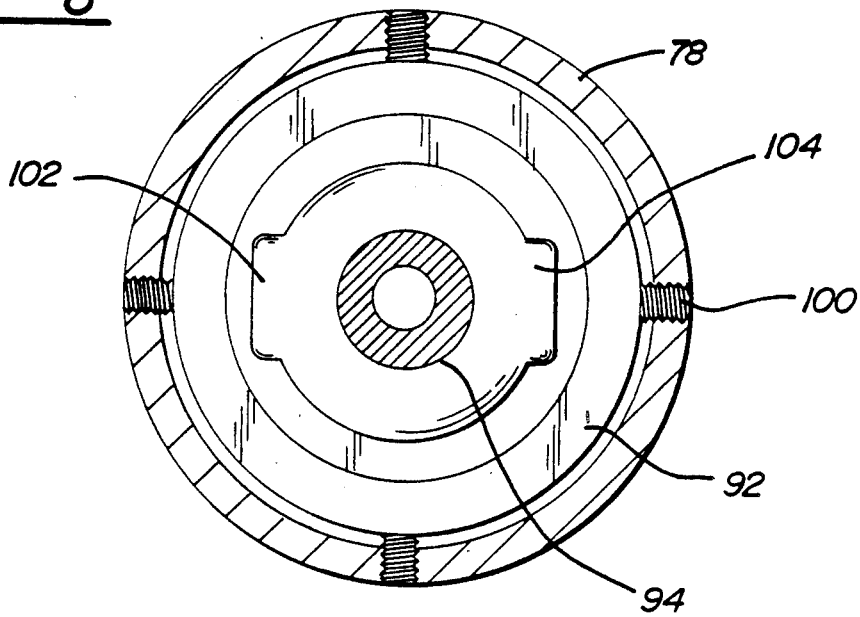
FIG. 8 is a plan view of a representative die insert in the arrangement of FIG. 8.

Ring holder 92 and carbide ring 94 is laterally adjustable within the die block 72 by means of four studs 100A, 100B, 100C and 100D. As best shown in FIGS. 7 and 8, there is a radial clearance between the outer periphery of the ring holder 92 and the inner surface of the die block 76 and the studs 100 are threaded through die block 76 to bear against the outer surface of the ring holder 92. By rotation of the studs 100 using a suitable tool, the spatial relationship between the inner diameter of the carbide ring 94 may be biaxially adjusted relative to the small diameter tip of the mandrel 90, thereby to compensate for any non-uniformities in tube wall thickness which may be detected.

As shown in FIG. 8, the ring holder 92 is also machined out to provide a symmetrical but non-circular inner cavity; i.e., there are lobes 102 and 104 along a lateral axis which corresponds essentially to the stock feed channels 84 and 86 in the die block 38. By causing the aluminum to feed into the lobes from opposite sides of the mandrel 91, a uniform fill of the die is assured.

B. Setup

The die subassembly 38 is first assembled according to the following steps:

(a) the mandrel holder 90, ring holder 92 and die block 76 are heated in an oven to about 1000° F. for one hour;

(b) mandrel 91 is thereafter inserted into the heated holder 90;

(c) the mandrel holder 90 and mandrel 91 are placed into a vise and, using a depth gage, the mandrel 91 is positioned to the proper depth; the mandrel holder 90 and mandrel 91 are then allowed to cool;

(d) the die insert 94 is placed into the ring holder 92 and tapped with a hammer to ensure seating; this assembly is allowed to cool;

(e) the mandrel assembly 90,91 is placed into the pocket 88 in the block 76;

(f) studs 100 are placed in block 76 and a pin gage is used to center the mandrel in the ring insert 94 by tightening the studs 100 as necessary;

(g) backer block 96 is fitted in face-to-face relationship with the die ring holder and screwed into position to fix the position of the ring holder and the carbide insert relative to the mandrel 90; and (h) the subassembly is then preferably filled with molten aluminum (or whatever material is being extruded) and allowed to cool before installation in the machine. This ensures that the mandrel 91 and insert 92,94 maintain the correct alignment with one another during the initial phases of the extrusion operation. It has also been found to hasten the warming up of the machine.

The subassembly 38 is then carried to the die assembly 18 and with the cylindrical recess 36 facing upward and the block 34 in place, the subassembly 38 is placed atop the block 34. Thereafter, the abutment holder 56 is placed atop the die block and long machine screws 57 are utilized to tie the assembly together securing the subassembly 38 between the abutment holder 56 and the shoe 30.

Build-up of assembly 18 may be detailed as follows:

(a) place spacer 34 into shoe 30;

(b) place die subassembly 38 into shoe 30 so feed ports 84,86 face right and left sides of shoe;

(c) place abutment holder 56 on die subassembly 38;

(d) insert bolts 57, thread into shoe 30 and tighten;

(e) center die subassembly 38 on shoe 30 and, using gage, align abutment holder 56 with die subassembly 38. A hammer may be used to tap parts into alignment;

(f) retighten bolts 57;

(g) place plates 44,50; 46,52 and 48,54 on shoe 30;

(h) insert abutments 58,59 into slots on sides of abutment holder 56 and mate with slots in plates 44,50; and (i) place blades 32,33 over ends of entry plates 44,50 and fasten to shoe 30 using bolts shown. As bolts are tightened, align plates 44,46 and 48 and 50,52,54 with one another by tapping with brass hammer. Edges of plates must be in alignment.

The assembly 18 is now ready for insertion into the extrusion machine. This is accomplished by opening the door 22 and placing the upper slide block 64 and the lower slide block (not shown) in the guide channels and pushing the assembly 18 along the longitudinal axis into the central position between the wheels 10 and 12. When the rear terminal surface 19 hits the fixed stop 20, the assembly is automatically properly position. The door 22 is thereafter closed and pinned shut, the bolts 70 (if desired) turned into position and the door cylinder 64 activated to a pressure of, for example, 7000 lbs. The machine is now ready for operation.

C. Operation

Referring to FIG. 1, feed stock, typically taken from coils, is manually fed into the grooves 60 of the wheels 10 and 12 by way of the coining idler wheels 110 and 112 and the electric or electro-hydraulic motors which turn the wheels 10 and 12 are activated. The idler wheels 110 and 112 actually coin the aluminum stock 14 and 16 into the grooves 60 such that the stock tends to follow the groove around into and through the arcuate feed path as the wheels are rotated. Friction against the pads 44, 46, 48, 50, 52 and 54 heat the stock and fluidize the stock. As the stock reaches the abutments 58 and 59 it is turned inwardly into the ports and feed channels 84 and 86 of the die block and into the mixing cavity where it flows around the mandrel 90 and axially outwardly through the die ring and the various axially openings in the shoe 30, the cylinder 64 and the door 22. Suitable and conventional apparatus is employed to cool, receive and coil the extruded stock as desired.

Figure 9:
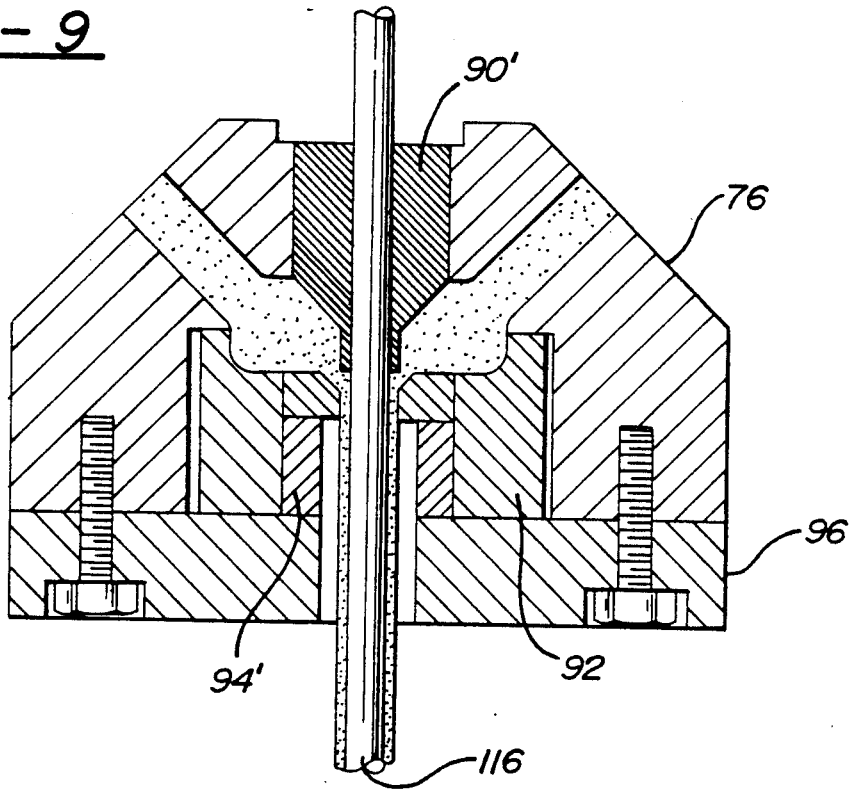
FIG. 9 is a schematic view of a die assembly for applying feed stock as a cladding to a core.

Referring now to FIG. 9, there is shown in schematic form a die assembly for applying the feed stock as a cladding to a core material 116 which is fed through a hollow mandrel 90'. To achieve the capability of feeding the core material 116, a through-bore must be provided in each of the rear stops 20 and the abutment holder 56' and of course a through-bore must also be provided in the mandrel 90'. Otherwise the physical arrangement is identical to that described with reference to the previous figures.

Operation is also similar to that previously described except for the fact that the core material 116 is continuously clad with an aluminum or copper sheath. The core material may be solid or stranded wires and may require a suitable pretreatment for good adhesion and compatibility between dissimilar metals. Pure copper conductors may be clad with aluminum. Coated cables may be clad with an aluminum sheath. Polymer-insulated cable, television cable and fiber-optic cables are all suitable for sheathing with this process.

What is claimed is:

1. A metal extrusion machine of the type having a pair of stock feed wheels having peripheral feed grooves for receiving the stock and mounted for rotation about spaced parallel axes relative to a rigid machine frame wherein the improvement comprises:

an extrusion die assembly having a rear terminal surface, a forward terminal surface, a longitudinal central extrusion output axis extending between said terminal surfaces, a die mounted concentrically about said axis in fixed spatial relation to and between said terminal surfaces and having oppositely inwardly directed input channels terminating in outboard ports;

stop means fixed to said machine frame mediate said wheels;

guide means for locating said assembly symmetrically between said wheel axes, perpendicular to said wheel axes, and against said stop means so that said ports are aligned with said grooves to receive said stock therefrom; and latch means bearing against said forward terminal surface to hold said assembly against said stop means during operation thereof.

2. Apparatus as defined in claim 1 wherein the die comprises an annular die ring and a mandrel having a head portion located concentrically of said ring to form in combination with said ring an annular path for the extrusion of tubing.

3. Apparatus a defined in claim 2 wherein said mandrel is fixed, the combination further including means for laterally adjusting the position of the die ring relative to the mandrel.

4. Apparatus as defined in claim further including metal stock feed plates disposed on opposite sides of said die assembly adjacent and spaced from the peripheries of said wheels, adjacent said peripheral grooves, said plates on each side being spaced along the periphery of said wheel to provide a continuous path for the flow of metal stock thereover en route to said ports.

5. Apparatus as defined in claim 4 wherein at least one plate in each of the plate assemblies on each side of the die assembly is provided with ports which match the outboard ports of said input channels.

6. Apparatus as defined in claim 5 further including abutment means carried by said die assembly adjacent each of said ports, each said abutment engaging a feed path plate and providing a terminus for the flow of metal stock over said plates and redirecting the flow of said stock into said ports.

7. Apparatus as defined in claim 1 wherein said latch means comprises a hinged door and an hydraulic cylinder arranged to act on and compress said die assembly along said longitudinal axis.

8. Apparatus as defined in claim 7 further including bolts secured through said door to said die assembly.

9. Apparatus as defined in claim 1 wherein said metal stock is aluminum.

10. For use in a metal extrusion machine of the type having a pair of stock feed wheels having peripheral feed grooves for receiving stock therein and mounted for rotation about spaced parallel axes relative to a rigid machine frame:

a die subassembly comprising a die block having a rear surface, a front surface, opposite angled lateral exterior surfaces, a central cavity, stock feed channels extending inwardly from the exterior surfaces to said cavity, and an axial through-bore mediate said surfaces and extending between the front and rear surfaces;

means for mounting an extrusion mandrel in said through-bore adjacent said rear surface and extending axially into said cavity;

an extrusion die ring having an axial bore and mounted in said cavity adjacent said front surface and axially aligned with said mandrel to define the inner and outer diameters of an extrusion therebetween; and means for laterally and axially securing said extrusion die in said die block.

11. Apparatus as defined in the die claim above, wherein said securing means permits lateral adjustment in the position of the extrusion die relative to the die block.

12. Apparatus as defined in claim 11 wherein said securing means comprises at least one set of opposing studs.

13. A method of operating an extrusion die for use in a metal extrusion machine of the type having a pair of stock feed wheels having peripheral feed grooves for receiving stock therein and mounted for rotation about spaced parallel axes relative to a rigid machine frame a die assembly being of the type which comprises a die block having a rear surface a front surface, opposite angled lateral exterior surfaces, a central cavity, stock feed channels extending inwardly from the exterior surfaces to said cavity, and an axial through-bore mediate said surfaces and extending between the front and rear surfaces, means for mounting an extrusion mandrel in said through-bore adjacent said rear surface and extending axially into said cavity;

an extrusion die ring having an axial bore and mounted in said cavity adjacent said front surface and axially aligned with said mandrel to define the inner and outer diameters of an extrusion therebetween;

means for laterally and axially securing said extrusion die in said die block, wherein the method comprises the steps of:

assembling the die block, extrusion mandrel and die ring; and filling the subassembly with molten metal of the type which is to be extruded through said die.

14. The method defined in claim 13 wherein the metal is aluminum.

* * * * *